US006553917B1

(12) United States Patent
Burke et al.

(10) Patent No.: US 6,553,917 B1
(45) Date of Patent: Apr. 29, 2003

(54) AUTO RACK RAILROAD CAR BUMPER GUARD DEVICE

(75) Inventors: Michael K. Burke, Wheaton, IL (US); John D. Anderson, Aurora, IL (US); Walter J. Peach, South Elgin, IL (US)

(73) Assignee: Zeftek, Inc., Montgomery, IL (US)

( * ) Notice: Subject to any disclaimer, the term of this patent is extended or adjusted under 35 U.S.C. 154(b) by 0 days.

(21) Appl. No.: 09/951,488

(22) Filed: Sep. 11, 2001

Related U.S. Application Data

(60) Provisional application No. 60/231,867, filed on Sep. 12, 2000.

(51) Int. Cl.[7] ..... B61D 45/00

(52) U.S. Cl. ..... 105/355; 105/404

(58) Field of Search ..... 105/355, 404, 105/423, 409, 378, 424, 396, 400; 52/716.2, 716.1, 716.5, 717.01, 717.03, 717.05

(56) References Cited

U.S. PATENT DOCUMENTS 1,827,784 A * 10/1931 Ditchfield ..... 105/400
5,239,933 A 8/1993 Murphy et al.
5,311,823 A * 5/1994 Rudibaugh et al. ..... 105/355
5,415,108 A 5/1995 Murphy et al.
5,579,697 A 12/1996 Burke
5,669,745 A 9/1997 Anderson
5,687,650 A 11/1997 Murphy et al.
5,694,859 A 12/1997 Burke et al.
5,701,825 A 12/1997 Peach, Jr.
5,762,001 A * 6/1998 Dworakowski ..... 105/355
5,787,816 A * 8/1998 Dworakowski et al. ..... 105/355

OTHER PUBLICATIONS

Edgegard Door Protection System written by ZefTek, Inc. published in 1998.
Rail Car Components Article written by Holland Transportation Technology published date unknown.
Thrall Bumper sample—Not Dated.

* cited by examiner

*Primary Examiner*—Mark T. Le
(74) *Attorney, Agent, or Firm*—Bell, Boyd & Lloyd LLC

(57) ABSTRACT

An auto rack sidewall bumper guard device for auto rack railroad cars eliminates contact between a vehicle door and the sidewalls. The bumper guard device includes a mounting plate and a plurality of horizontally extending vertically spaced-apart relatively low profile bumpers extending from the mounting plate. The mounting plate is adapted to cover the sidewall panel and part of each adjacent vertical posts to prevent the vehicle doors from contacting the sidewall panels and vertical posts.

58 Claims, 4 Drawing Sheets

AUTO RACK RAILROAD CAR BUMPER GUARD DEVICE

PRIORITY CLAIM

This patent application claims the benefit of U.S. provisional patent application No. 60/231,867, filed Sep. 12, 2000, the entire contents of which are hereby incorporated by reference and relied upon.

DESCRIPTION

This invention relates in general to an auto rack railroad car bumper guard device, and more particularly to an auto rack railroad car bumper guard device which is adapted to be mounted on a sidewall of an auto rack railroad car to prevent vehicle doors from contacting the sidewall and thus prevent damage to the vehicles doors.

BACKGROUND OF THE INVENTION

The railroad industry employs a variety of railroad cars for transporting products including vehicles such as automobiles and trucks. Auto rack railroad cars transport newly manufactured vehicles, including automobiles, vans and trucks. Auto rack railroad cars, known in the railroad industry as auto rack cars, often travel thousands of miles through varying terrain. The typical auto rack car is compartmented, having two or three floors or decks, two sidewalls, a pair of doors at each end, and a roof. The sidewalls are constructed of numerous sidewall panels made of galvanized steel or aluminum which are attached between vertical posts that are spaced evenly throughout the length of the auto rack car.

One problem with auto rack cars is the damage to newly manufactured vehicle doors which often occurs in the auto rack cars. Newly manufactured vehicles are loaded into the auto rack car by a person who drives the vehicle into the auto rack car. After correctly positioning the vehicle, the person must open the vehicle door to exit the vehicle. When the vehicle door is opened, the door can contact with the sidewalls (including the sidewall panels and vertical posts) and/or the roof because there is only a limited amount of space between the vehicle and the sidewalls on any level or the vehicle and roof on the upper level of the auto rack car. This metal-to-metal contact can and often does scratch, dent and otherwise damage the finish of the door of the newly manufactured vehicle.

One method which has been used to solve the door damage problem is the application of mastic-backed tape over the sidewall panel as a guard for the vehicle doors. This method has been unsuccessful for several reasons. First, the surfaces of the sidewall panel which contact the adhesive side of the tape must be specially cleaned before the tape is applied. Otherwise, the tape will not properly adhere to the panels. Second, the extreme changes in temperature and the constant abuse from the sun and other elements of nature cause the tape to deteriorate and peel away. Third, the tape can be used only one time. Fourth, and finally, the tape and adhesive must be scraped off and/or removed by a special solvent. This removal process is difficult, costly and time-consuming. Therefore, the application of tape to protect the vehicle doors does not solve the problem. Additionally, certain tapes can be hazardous waste.

Another method which has been used to prevent the vehicle doors from contacting the sidewall panels is to horizontally stretch a nylon belt across the sidewall panels and attach the ends of the belts to each end of the auto rack cars, approximately eighty feet apart. However, this method has been unsuccessful even with the addition of guides which are glued or welded to the vertical posts. The stretching of nylon belts between the two ends of the auto rack cars causes the belt to lose tension. This loss in tension causes the nylon belt to sag. When the nylon belt sags, it does not prevent the vehicle door from contacting the sidewall panels. To solve this problem, the nylon belt has to be constantly retensioned by ratchet tightening at one end of the auto rack car. Eventually, the nylon belts become completely stretched out and must be replaced. Accordingly, this method does not solve the problem.

A further method which has been used to prevent the vehicle doors from contacting the sidewall panels is to horizontally strap a rubber hose across the length of the auto rack car. However, this method has been unsuccessful because the rubber hose sags, because the straps holding the rubber hose often break, and because the hose does not sufficiently cover the sidewall panels. Thus, this method also fails to solve the problem.

Other methods such as attaching large rubber mats to the sidewall panels and coating the sidewall panels with a thin layer of spray-on foam have similarly failed to provide adequate protection for the newly manufactured vehicle doors.

A further apparatus which has been successful in preventing the vehicle's door from contacting the sidewall panels is disclosed in U.S. Pat. No. 5,239,933. U.S. Pat. No. 5,239,933 disclosed a bumper guard which is a single piece of plastic, such as vinyl or polyethylene, or other suitable material which is extruded into a preformed shape. The bumper guard includes a mounting base which has slots for the insertion of a fastener for attachment to the sidewall panel, and a bumper extending from the mounting base which prevents the vehicle door from contacting the sidewall panels. Numerous types of fasteners can be inserted in the slots of the mounting base and through the sidewall panel holes, thereby securing the bumper guard to the sidewall panel. Other substantially similar types of devices are also known. However, the devices disclosed in these patents are not adapted for certain new types of auto rack cars which vary in construction. Accordingly, there is a need for an auto rack bumper guard device for such auto rack cars.

SUMMARY OF THE INVENTION

The present invention solves the above problem by providing an auto rack sidewall bumper guard device for auto rack railroad cars which eliminates contact between the doors of the vehicles transported in such auto rack cars and the sidewalls. The bumper guard device of the present invention is adapted to be mounted on certain types of auto rack railroad cars (as described below) and generally includes a mounting plate and a plurality of horizontally extending vertically spaced-apart relatively low profile bumpers extending from the mounting plate. The mounting plate is adapted to cover a substantial area of the sidewall panel and part of each adjacent vertical posts to prevent the vehicle doors from contacting the sidewall panels and vertical posts.

It is therefore an object of the present invention to provide an auto rack railroad car sidewall bumper guard device.

Other objects, features and advantages of the present invention will be apparent from the following detailed disclosure, taken in conjunction with the accompanying sheets of drawings, wherein like reference numerals refer to like parts.

DETAILED DESCRIPTION OF THE INVENTION

Figure 1:
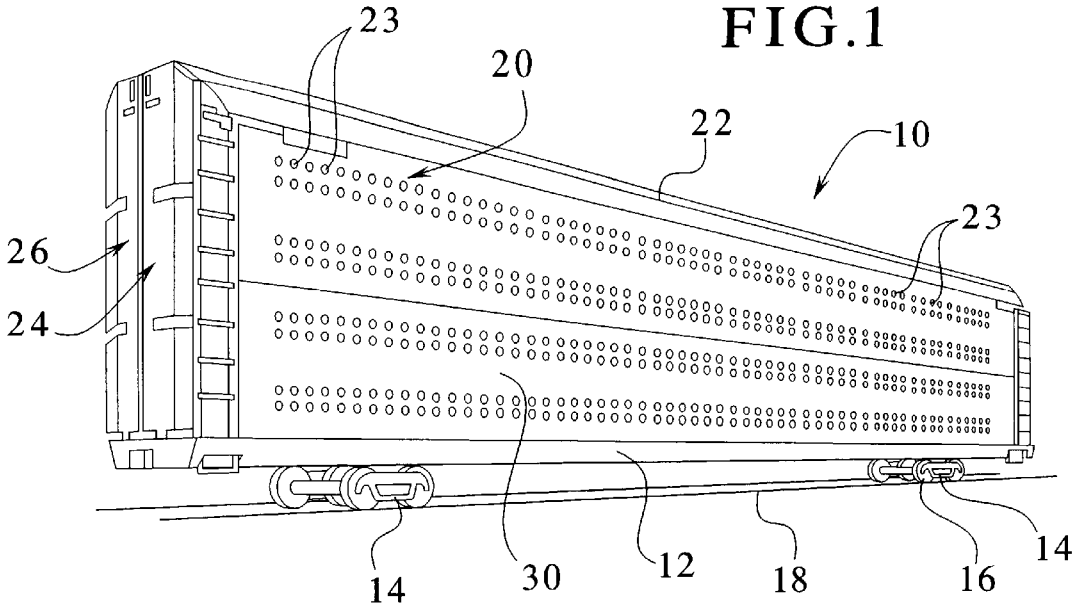
FIG. 1 is a perspective view of an auto rack railroad car.
Figure 2:
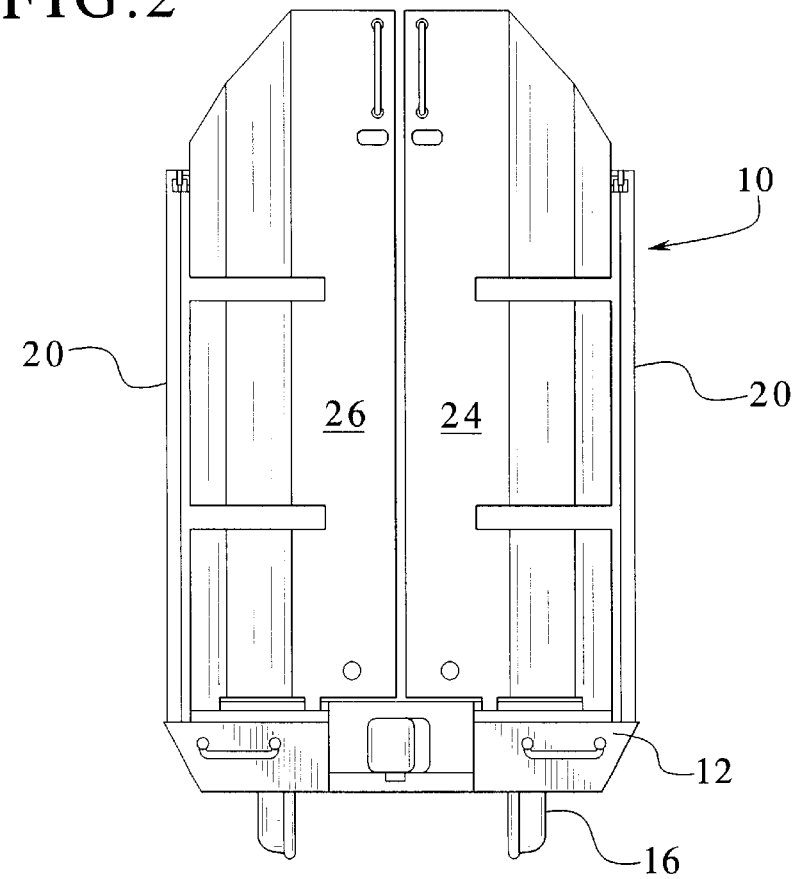
FIG. 2 is an end view of an auto rack railroad car.
Figure 3:
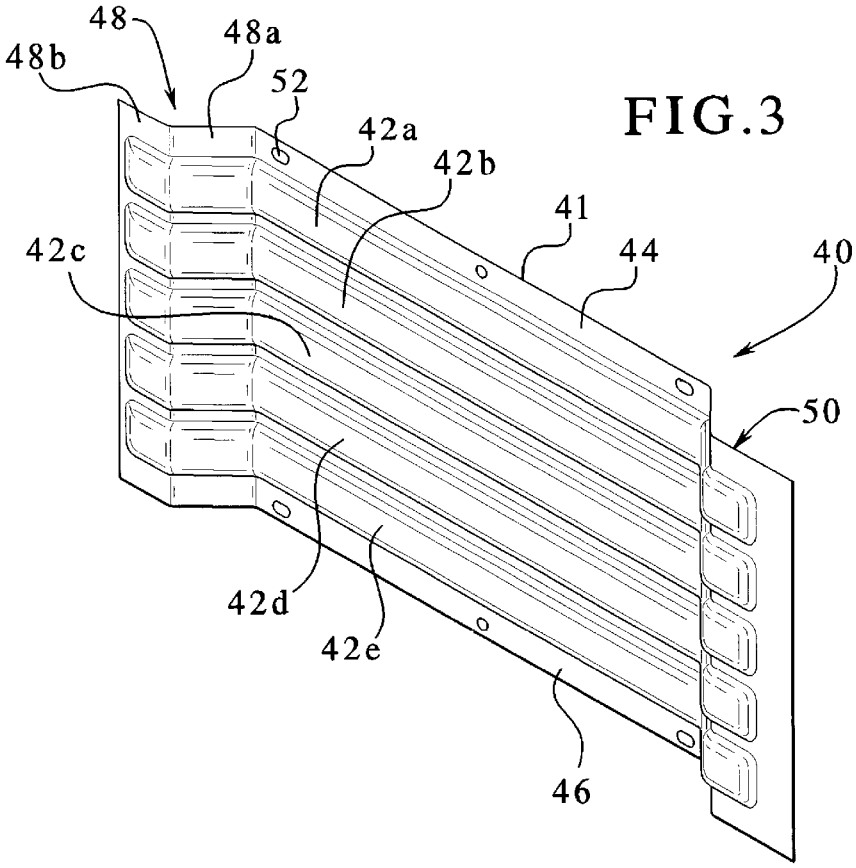
FIG. 3 is a perspective view of a bumper guard device of one embodiment of the present invention.
Figure 7:
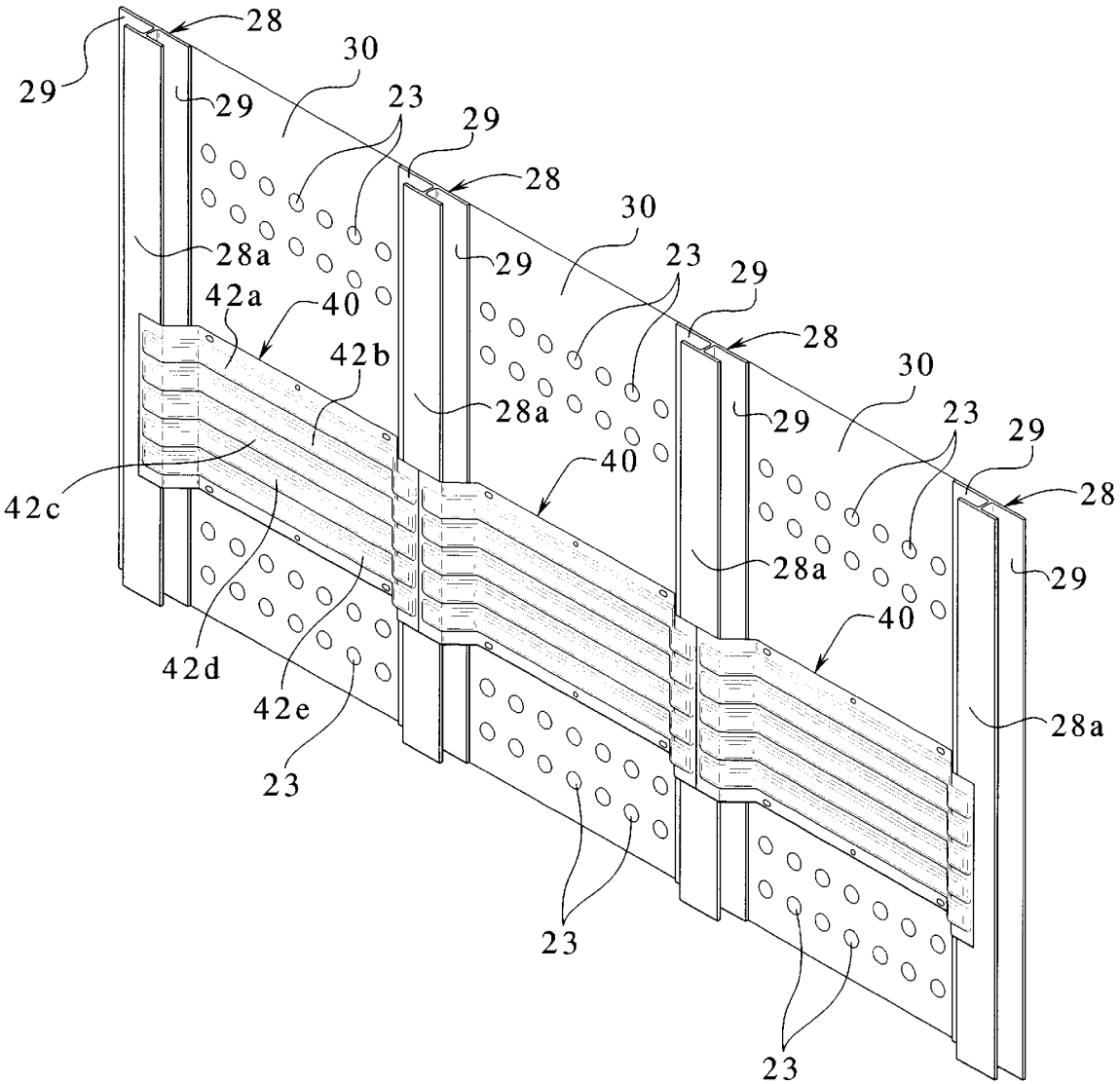
FIG. 7 is a perspective view of a plurality of the bumper guard devices of FIG. 3 mounted on part of the interior sidewall of an auto rack car.

Referring now to the drawings, and particularly to FIGS. 1, 2 and 7, a typical auto rack car 10 includes a frame 12 supported by trucks 14, each of which have several wheels 16 which roll along railroad tracks 18. The frame 12 supports two sidewalls 20 and a roof 22. The auto rack car 10 includes a pair of coacting clamshell doors 24 and 26 mounted on each end of the auto rack car 10. The doors 24 and 26 are opened to facilitate the loading and unloading of vehicles into and out of the auto rack car 10 and are closed during transport or storage of the vehicles.

The sidewalls 20 include a series of aluminum vertical posts 28 which are mounted on and extend upwardly from the frame 12. The roof 22 is mounted on and supported by these vertical posts. The vertical posts are evenly spaced along the entire length of both sidewalls 20 of the auto rack car 10. In this construction of the auto rack car, aluminum one-piece sidewall panels 30 are mounted to extensions 29 of the vertical posts 28. These sidewall panels are hucked, bolted or otherwise suitably secured to the vertical posts. The average sidewall panel has a multiplicity of round sidewall panel holes 23 that are at least five-eighths of an inch or greater in diameter. These sidewall panel holes provide the auto rack car with natural light as well as proper ventilation. Proper ventilation in auto rack cars prevents harm from the toxic vehicle fumes to the person or persons loading or unloading the vehicles into or out of the auto rack car.

The auto rack car may be a tri-level car having first, second and third levels. Normally, eighteen passenger vehicles can be transported in a tri-level auto rack car, six on each level. The auto rack car can also have two levels for vehicles instead of three. The bi-level auto rack car has a lower level and an upper level. The bi-level auto rack car is generally used to transport larger vehicles, such as vans, mini-vans, pickup trucks, and four-by-four vehicles. The bi-level auto rack car can usually transport twelve of these vehicles, six on each level.

One embodiment of the bumper guard device 40 of the present invention is generally illustrated in FIGS. 3 through 7. The bumper guard device 40 is preferably an elongated molded one-piece plastic member. However it should be appreciated that the bumper guard device of the present invention could be constructed from a plurality of pieces, could be made in any suitable manner and could be made from any other suitable material. The bumper guard 40 includes a horizontally extending mounting plate 41 which is adapted to be mounted adjacent to the sidewall panel 30 and the vertical posts 28 as illustrated in FIG. 7, and a plurality of horizontally extending vertically spaced-apart relatively low profile bumpers 42*a* to 42*e* integrally formed with and laterally extending from the mounting plate 41.

More particularly, the mounting plate 41 includes a body 43, an upper mounting base or member 44, a lower mounting base or member 46, a first post cover 48 extending from one end of the body 43 and a second post cover 50 extending from the other end of the body 43. The first and second post covers are angled and adapted to cover the vertical posts 28 in an overlapping relationship as shown in FIG. 7. More specifically, the post covers each include an angled portion 48*a* and 50*a* respectively and a straight or engaging portion 48*b* and 50*b*, respectively. The post engaging portion is adapted to engage or contact the inner surface 28*a* of the post.

The upper mounting base 44 and lower mounting base 46 each have a series of longitudinally spaced preferably oval slots 52 of about one-and-three-quarters inches long and five-eighths inch high for aligning with and coacting with the sidewall panel holes 23 to receive suitable fasteners (not shown) when the bumper guard device 40 is mounted on a sidewall panel 30. Any suitable fastener may be used to attach the bumper guard device to the sidewall panel such as those described in U.S. Pat. No. 5,239,933. The slots allow for expansion and contraction of the bumper guard device 40 and facilitate the mounting and aligning with panel holes.

The plurality of horizontally extending low profile somewhat C-shape bumpers 42*a* to 42*e* are integrally formed with, connected to and extend transversely from or project from the mounting plate 41 including the portions 48*a*, 48*b*, 50*a* and 50*b* of the first and second post covers 48 and 50, respectively. The bumpers 42*a* to 42*e* are adapted to absorb the impact energy of a vehicle door (not shown) and prevent the vehicle door from contacting the sidewall panels 30 and any portions of the vertical posts 28. The bumpers 48 are preferably molded from a plastic, as described below, that gives the desired flexibility and resiliency to absorb impact forces from a vehicle door without causing any damage to the door or finish thereof.

Figure 4:
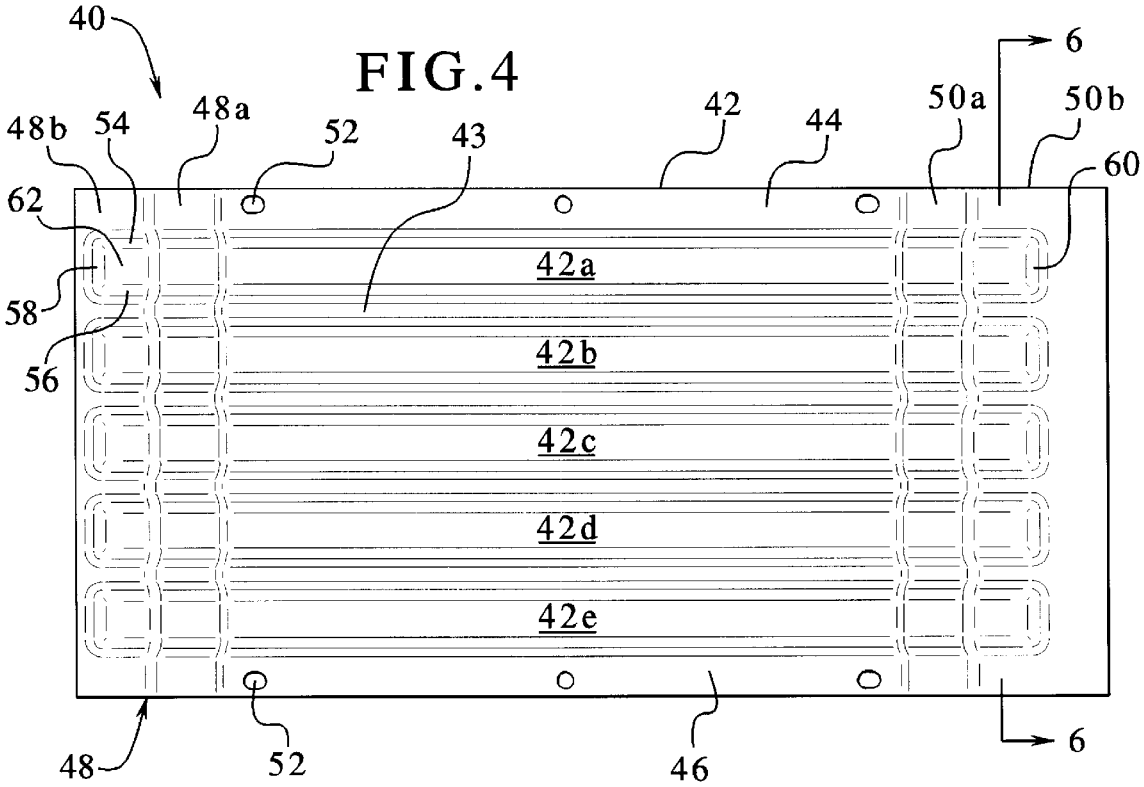
FIG. 4 is front plan view of the bumper guard device of FIG. 3.
Figure 5:
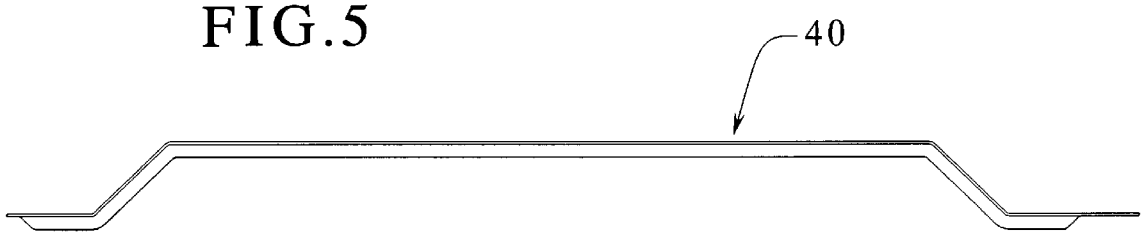
FIG. 5 is top plan view of the bumper guard device of FIG. 3.
Figure 6:
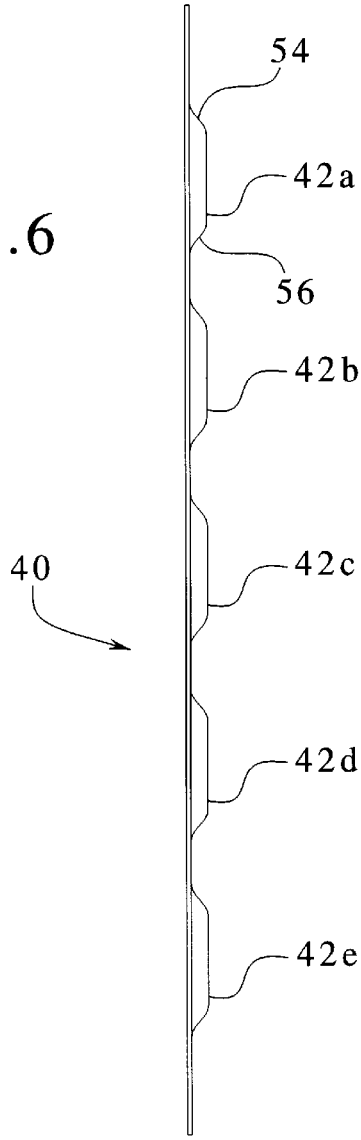
FIG. 6 is a enlarged cross-sectioned view of the bumper guard device of FIG. 3 taken substantially through line 6—6 of FIG. 4.

In one embodiment, as best illustrated in FIGS. 4 and 6, each bumper includes: (a) spaced apart opposing substantially horizontal extending parallel arms or members 54 and 56 integrally formed with, connected to and extending from the mounting plate; (b) spaced apart vertically extending end arms or members 58 and 60 integrally formed with, connected to and extending from the first and second post covers 48 and 50, respectively of the mounting plate 41, and specifically form the engaging portions 48*b* and 50*b*; and (c) a vehicle door contact section 62 connected to said arms or members. Each bumper 42*a* to 42*e* therefore includes multiple sections disposed in multiple planes. Specifically each bumper includes an intermediate section two end sections and two angled connecting sections extending between the intermediate sections and the end sections. This construction provides for complete protection of the vehicle doors to prevent the vehicle doors from contacting the sidewall panels and vertical post. Of course, the bumper guard device 40 is mounted to the sidewall panels at the appropriate height for the vehicles transported in the auto rack car. It should be appreciated that since the bumper guard has multiple bumpers, the car doors of varying height will contact different bumpers at different locations.

One embodiment of the bumper guard device is made and is molded from a Low Density Polyethylene of approximately a sixty D (60D) durometer harness rating. It should be appreciated that the bumper guard device may be made from other suitable materials such as urethane, rubber, flexible PVC or a combination of rigid and flexible PVC. The bumper guard device also preferably has a UV inhibitor which incorporates a suitable hindered amine light stabilizer.

The UV inhibitor prevents the deterioration of the bumper guard device from ultraviolet rays. Other UV inhibitors could be used in the bumper guard device. It should also be appreciated that since the bumper guard is mounted inside the auto rack car instead of on the outside, it is partially protected from the damaging ultraviolet rays.

As indicated above, it should be appreciated that the mounting plate and the bumper are preferably integrally formed; however, the mounting plate and bumper could be formed from a plurality of pieces. For example, each bumper could be formed to be inserted or snapped into the mounting plate.

It will be understood that modifications and variations may be effected without departing from the scope of the novel concepts of the present invention, and it is understood that this application is to be limited only by the scope of the claims.

The invention is claimed as follows:

1. In an auto rack railroad car having a plurality of horizontally extending sidewalls which include a plurality of spaced apart vertical posts and sidewall panels connected to the vertical posts, a bumper guard adapted to be mounted adjacent to one of the sidewall panels, said bumper guard comprising:

a mounting plate which is adapted to be mounted adjacent to the sidewall panel, said mounting plate including a mounting body, an upper mounting base connected to said mounting body, a lower mounting base connected to said mounting body, a first post cover extending from one side end of said mounting body and a second post cover extending from the other side end of said mounting body; and a plurality of spaced-apart bumpers extending transversely from the mounting plate, wherein the mounting plate is adapted to cover part of the sidewall panel and part of adjacent vertical posts to prevent a vehicle door from contacting said sidewall panel and said vertical posts.

2. The bumper guard of claim 1, wherein the first and second post covers each include an angled portion and a straight portion for covering said vertical posts.

3. The bumper guard of claim 1, wherein the upper mounting base and the lower mounting base each have a series of longitudinally spaced slots for aligning with and co-acting with sidewall panel holes in said sidewall panels.

4. The bumper guard of claim 1, wherein each of said spaced apart bumpers includes:

a) spaced-apart opposing substantially horizontally extending members extending from the mounting plate;

b) spaced-apart vertically extending end members extending from the first and second post covers of the mounting plate; and c) a vehicle door contact section connected to said members.

5. The bumper guard of claim 1, which is made from a material selected from the group consisting of urethane, rubber, polyethylene, flexible PVC, a combination of rigid and flexible PVC, and combinations thereof.

6. The bumper guard of claim 5, which includes a UV inhibitor.

7. The bumper guard of claim 1, which is made from a low density polyethylene.

8. The bumper guard of claim 7, which includes a UV inhibitor.

9. The bumper guard of claim 1, wherein said bumpers are molded from a plastic.

10. The bumper guard of claim 9, wherein said bumpers includes a UV inhibitor.

11. The bumper guard of claim 1, wherein said mounting plate and said bumpers are integrally formed.

12. A bumper guard for preventing vehicle doors from contacting the sidewall panel in an auto rack railroad car, said bumper guard comprising:

a mounting plate, adapted to be attached to the sidewall panel, said mounting plate including a sidewall covering portion, a first vertical post covering portion formed at an end of the mounting plate, an upper mounting base, a lower mounting base and a series of longitudinally spaced slots for aligning and co-acting with sidewall panel holes in said sidewall panel; and a plurality of low profile bumpers extending from the mounting plate.

13. The bumper guard of claim 12, wherein the bumpers extend from the sidewall covering portion and the vertical post covering portion.

14. The bumper guard of claim 12, wherein the first post covering portion adapted to cover at least a portion of a vertical post adjacent to the sidewall panel, wherein said bumpers extend from the body and the first post covering portion.

15. The bumper guard of claim 12, wherein the mounting plate includes a second post covering portion formed at the other end of the mounting plate, wherein said first and second post covering portions cover the vertical posts adjacent to the sidewall panel.

16. The bumper guard of claim 15, wherein each post covering portion includes an angled portion and a straight portion.

17. The bumper guard of claim 15, wherein the bumpers are integrally formed with the side covering portion and post covering portions.

18. The bumper guard of claim 15, wherein each of the bumpers includes spaced apart opposing substantially horizontally extending members integrally formed with and extending from the mounting plate, spaced apart vertically extending members integrally formed with and connected to the post covering portion and a vehicle door contact section connected to said members.

19. The bumper guard of claim 12, wherein each bumper includes an intermediate section, two end sections and two angled sections extending respectively between the intermediate section and the end sections.

20. The bumper guard of claim 12, wherein said bumper guard is made from a material selected from the group consisting of urethane, rubber, polyethylene, flexible PVC, a combination of rigid and flexible PVC, and combinations thereof.

21. The bumper guard of claim 20, wherein said bumper guard includes a UV inhibitor.

22. The bumper guard of claim 12, wherein said bumper guard is made from a low density polyethylene.

23. The bumper guard of claim 22, wherein said bumper guard includes a UV inhibitor.

24. The bumper guard of claim 12, wherein said bumpers are molded from a plastic.

25. The bumper guard of claim 24, wherein said bumpers includes a UV inhibitor.

26. The bumper guard of claim 12, wherein said mounting plate and said bumpers are integrally formed.

27. In an auto rack railroad car having a plurality of horizontally extending sidewalls which include a plurality of spaced apart vertical posts and sidewall panels connected to the vertical posts, a bumper guard adapted to be mounted adjacent to one of the sidewall panels, said bumper guard comprising:

a mounting plate which is adapted to be mounted adjacent to the sidewall panel, said mounting plate including a mounting body and a post cover extending from at least one side end of the mounting body, said post cover including an angled portion and a substantially straight portion for covering one of the vertical post adjacent to said sidewall panel; and a plurality of bumpers extending transversely from the mounting plate, wherein the mounting plate is adapted to cover part of the sidewall panel and part of said adjacent vertical post to prevent a vehicle door from contacting said sidewall panel and said vertical post.

28. In an auto rack railroad car having a plurality of horizontally extending sidewalls which include a plurality of spaced apart vertical posts and sidewall panels connected to the vertical posts, a bumper guard adapted to be mounted adjacent to one of the sidewall panels, said bumper guard comprising:

a mounting plate having a mounting body which is adapted to be mounted adjacent to the sidewall panel;

a plurality of bumpers extending transversely from the mounting plate; and a first post cover extending from one side end of the mounting body and a second post cover extending from an opposite side end of the mounting body, wherein the mounting body, the first post cover and the second post cover are adapted to cover part of the sidewall panel and part of each vertical post adjacent to said sidewall panel to prevent a vehicle door from contacting said sidewall panel and said vertical posts.

29. The bumper guard of claim 28, wherein the first and second post covers each include an angled portion and a straight portion for covering such vertical posts.

30. A bumper guard for preventing a vehicle door from contacting a sidewall panel and a vertical post adjacent to said sidewall panel in an auto rack railroad car, said bumper guard comprising:

a mounting plate adapted to be attached to said sidewall panel, said mounting plate including a body and a post cover extending from one end of the body, said post cover including an angled portion and a substantially straight portion and adapted to cover at least a portion of said vertical post; and a plurality of low profile bumpers extending from said body and said post cover.

31. The bumper guard of claim 30, wherein the bumpers are integrally formed with the body and post cover.

32. The bumper guard of claim 30, wherein said bumper guard is made from a material selected from the group consisting of urethane, rubber, polyethylene, flexible PVC, a combination of rigid and flexible PVC, and combinations thereof.

33. The bumper guard of claim 32, wherein said bumper guard includes a UV inhibitor.

34. The bumper guard of claim 30, wherein said bumper guard is made from a low density polyethylene.

35. The bumper guard of claim 34, wherein said bumper guard includes a UV inhibitor.

36. In an auto rack railroad car having a plurality of horizontally extending sidewalls which include a plurality of spaced apart vertical posts and sidewall panels connected to the vertical posts, a bumper guard adapted to be mounted adjacent to one of the sidewall panels, said bumper guard comprising:

a mounting plate adapted to be mounted adjacent to said sidewall panel to cover part of the sidewall panel; and a plurality of spaced-apart bumpers extending transversely from the mounting plate to prevent a vehicle door from contacting said sidewall panel, wherein each of said bumpers includes spaced-apart opposing substantially horizontally extending members extending from the mounting plate, spaced-apart vertically extending end members extending from the mounting plate, and a vehicle door contact section connected to said members.

37. The bumper guard of claim 36, wherein the mounting plate includes a mounting body, an upper mounting base connected to said mounting body, a lower mounting base connected to said mounting body, a first post cover extending from one side end of the mounting body.

38. The bumper guard of claim 37, which includes a second post cover extending from the other side end of the mounting body.

39. The bumper guard of claim 38, wherein the first and second post covers each include an angled portion and a straight portion for covering vertical posts adjacent to said sidewall panel.

40. The bumper guard of claim 36, wherein the mounting plate includes an upper mounting base and the lower mounting base each have a series of longitudinally spaced slots for aligning with and co-acting with sidewall panel holes in said sidewall panels.

41. The bumper guard of claim 40, which is made from a material selected from the group consisting of urethane, rubber, polyethylene, flexible PVC, a combination of rigid and flexible PVC, and combinations thereof.

42. The bumper guard of claim 41, which includes a UV inhibitor.

43. The bumper guard of claim 30, which is made from a low density polyethylene.

44. The bumper guard of claim 43, which includes a UV inhibitor.

45. The bumper guard of claim 36, wherein said mounting plate and said bumpers are integrally formed.

46. A bumper guard for preventing a vehicle door from contacting a sidewall panel in an auto rack railroad car having a plurality of vertical posts and sidewall panels mounted to the vertical posts, said bumper guard comprising:

a mounting plate adapted to be attached to the sidewall panel, wherein the mounting plate includes a sidewall covering portion and a vertical post covering portion; and a plurality of low profile bumpers transversely extending from the mounting plate including extending from the sidewall covering portion and extending from the vertical post covering portion, wherein each of said bumpers includes spaced-apart opposing substantially horizontally extending members extending from the mounting plate spaced-apart vertically extending end members extending from the mounting plate, and a vehicle door contact section connected to said members.

47. The bumper guard of claim 46, wherein the mounting plate includes a sidewall covering portion and a vertical post covering portion.

48. The bumper guard of claim 47, wherein the bumpers extend from the sidewall covering portion and the vertical post covering portion.

49. The bumper guard of claim 46, wherein the mounting plate includes an upper mounting base, a lower mounting base and a series of longitudinally spaced slots for aligning and co-acting with sidewall panel holes in said sidewall panel.

50. A bumper guard for preventing a vehicle door from contacting a sidewall panel in an auto rack railroad car having a plurality of vertical posts and sidewall panels mounted to the vertical posts, said bumper guard comprising:

a mounting plate adapted to be attached to the sidewall panel, wherein the mounting plate includes a body, a post cover extending from one end of the body and adapted to cover at least a portion of one of the vertical posts adjacent to the sidewall panel; and a plurality of low profile bumpers transversely extending from the mounting plate including extending from the body and extending from the post cover, wherein each of said bumpers includes spaced-apart opposing substantially horizontally extending members extending from the mounting plate spaced-apart vertically extending end members extending from the mounting plate, and a vehicle door contact section connected to said members.

51. The bumper guard of claim 46, wherein the mounting plate includes a body, a first post cover extending from one end of the body and a second post cover extending from the other end of the body, wherein said first and second post covers cover a portion of the vertical posts adjacent to said sidewall panel.

52. The bumper guard of claim 46, wherein said bumper guard is made from a material selected from the group consisting of urethane, rubber, polyethylene, flexible PVC, a combination of rigid and flexible PVC, and combinations thereof.

53. The bumper guard of claim 52, wherein said bumper guard includes a UV inhibitor.

54. The bumper guard of claim 46, wherein said bumper guard is made from a low density polyethylene.

55. The bumper guard of claim 54, wherein said bumper guard includes a UV inhibitor.

56. The bumper guard of claim 46, wherein said mounting plate and said bumpers are integrally formed.

57. In an auto rack railroad car having a plurality of horizontally extending sidewalls which include a plurality of spaced apart vertical posts and sidewall panels connected to the vertical posts, a bumper guard adapted to be mounted adjacent to one of the sidewall panels, said bumper guard comprising:

a mounting plate adapted to be mounted adjacent to said sidewall panel, said mounting plate including a sidewall covering portion, a vertical post covering portion formed at an end of the mounting plate, an upper mounting base, and a lower mounting base, each said base having a series of longitudinally spaced slots for aligning with and co-acting with sidewall panel holes in said sidewall panel; and a plurality of spaced-apart bumpers extending transversely from the mounting plate, wherein the mounting plate is adapted to cover part of the sidewall panel to prevent a vehicle door from contacting said sidewall panel.

58. A bumper guard for preventing a vehicle door from contacting the sidewall panel in an auto rack railroad car having a plurality of vertical posts and sidewall panels mounted to the vertical posts, said bumper guard comprising:

a mounting plate adapted to be attached to said sidewall panel, wherein the mounting plate includes a mounting body, an upper mounting base connected to said mounting body, a lower mounting base connected to said mounting body, a first vertical post cover extending from one side end of the mounting body and a second post cover extending from the other side end of the mounting body; and a plurality of low profile bumpers extending from the mounting body, extending from the first post cover and extending from the second post cover of the mounting plate.

* * * * *